United States Patent [19]

Leidel et al.

[11] Patent Number: 4,681,267

[45] Date of Patent: Jul. 21, 1987

[54] METHOD OF REGENERATING OLD CASTING SAND

[76] Inventors: Dieter S. Leidel, R.R. No. 5, Barrier, Ontario L4M 4S7, Canada; Hubert Eirich, Sandweg 16, 6969 Hardheim, Fed. Rep. of Germany; Paul Eirich, Bahnhofstrabe 11, 6969 Hardheim, Fed. Rep. of Germany; Walter Eirich, Spessartweg 18, 6969 Hardheim, Fed. Rep. of Germany

[21] Appl. No.: 720,129

[22] Filed: Apr. 5, 1985

Related U.S. Application Data

[63] Continuation-in-part of Ser. No. 497,482, May 23, 1983, abandoned.

[30] Foreign Application Priority Data

Mar. 16, 1983 [DE] Fed. Rep. of Germany ..... 3309379

[51] Int. Cl.[4] ..... B02C 19/18

[52] U.S. Cl. ..... 241/23; 164/5; 164/412; 241/24; 241/DIG. 10

[58] Field of Search ..... 241/23, 24, DIG. 10, 241/65, 66; 164/412, 5

[56] References Cited

U.S. PATENT DOCUMENTS

| | | | |
|---|---|---|---|
| 2,456,769 | 12/1948 | Christensen et al. | 241/65 X |
| 2,515,194 | 7/1950 | Christensen | 241/23 X |
| 3,173,794 | 3/1965 | Reckon | 241/8 X |
| 3,690,622 | 9/1972 | Brunner et al. | 259/169 |

FOREIGN PATENT DOCUMENTS

| | | | |
|---|---|---|---|
| 2651154 | 12/1977 | Fed. Rep. of Germany | 164/412 |

OTHER PUBLICATIONS

"Toward the Closed System by Reclaiming Green Sand", Leidel, Eirich Machines Ltd., Maple, Ontario, Canada.

*Primary Examiner*—Howard N. Goldberg
*Assistant Examiner*—Joseph M. Gorski
*Attorney, Agent, or Firm*—Bean, Kauffman & Bean

[57] ABSTRACT

A method of regenerating old casting sand consists of the steps of introducing essentially dry, used casting sand into a single container, then simultaneously subjecting the sand to rapid heating and extreme turbulence by directing a gas flame against the sand having a temperature of at least 1400° C. (2550° F.) along a first axis, rotating a crushing tool about a second axis parallel to the first axis and positioned such that the crushing tool does not pass through the gas flame and rotating the container about a third axis, parallel to the first and second axes. In a preferred embodiment, the container is cylindrical in shape and the third axis is inclined from the vertical at an angle of between 10° and 60°, thereby creating upper and lower zones. The burner flame preferably is directed to the sand in the lower zone and the crushing tool is positioned to operate in the upper zone. By simultaneously contacting the oil sand with a source of intense heat and subjecting the sand to violent agitation, the binder encasing the grains of sand is rapidly embrittled and the old sand particles are subjected to thermal shock in which the boundary faces between the binder and the sand grains are subjected to stress, thereby accelerating the disintegration of the binder and its removal from the individual sand grains.

1 Claim, 4 Drawing Figures

METHOD OF REGENERATING OLD CASTING SAND

CROSS REFERENCE TO RELATED APPLICATION

This application is a continuation-in-part of U.S. application Ser. No. 497,482, filed May 23, 1983; now abandoned.

BACKGROUND OF THE INVENTION

The invention relates to a method of regenerating old casting or foundry sand by thermal and mechanical processing and, more particularly, to methods for regenerating old casting sand which make efficient use of thermal energy.

There are various molding sand systems currently used in foundries. Some use inorganic binders such as clay, and others use organic binders such as synthetic resin. Among the latter sand systems are those which sue binding agents containing a volatile solvent. Systems using organic binders are used primarily for the mask molding method while systems which use synthetic resin binders are used predominantly for core molding. Finished sand with clay as the binding agent is used primarily for the areas outside the core of a mold.

The expression "molding sand system with clay" is used to denote the cycle wherein finished sand is put into the mold, a molding operation is performed in the casting process, and the sand is discharged after the emptying operation in the form of old sand. The old sand is at least partly mixed again with fresh sand, bentonite, water and coal dust to make it useable again.

In such a molding sand system with clay, which is commonly used, there is a continuous need for fresh or new sand. That sand is required to compensate for losses and to replace damaged sand. Fresh sand is also used for producing cores which contain synthetic resin as the binder. Losses occur when emptying out the molds after the casting operation, such as when trimming, fettling, or cleaning out.

The quality of sand required for producing the cores is generally higher than that required for producing the other finished sand in the outer parts of the mold. Frequently, after a casting operation, cores are broken up to be recycled so that the high quality sand they contain is used to compensate for the lost amount of sand in the molding sand system with clay. In known molding sand systems wtih clay, the requirement for fresh sand is increasingly directed to the sand needed for the cores, and therefore, such sand must be fresh sand of high quality.

Experience has shown that in foundry plants, large quantities of old sand are dumped as waste after the molds have been emptied out, both to compensate for the surplus or excess due to the supply for the core, and to keep the average quality of the circulating old sand at a constant value. Much effort is currently underway to optimize processing of the waste sand in order to produce a new sand of such high quality that it can be used to form a core. Such efforts are partly motivated by economic considerations because the transportation and storage of used sand involves additional costs.

Although the current demand for lower quality sand can be filled by presently existing reprocessing plants, there is a need for new sand or processed old sand of a higher quality for making mold cores. In order to produce such higher quality sand, neither mechanical nor thermal regeneration of old sand alone is sufficient, but a combination of thermal and mechanical processing of old sand is required.

Such methods of regenerating old sand by thermal and mechanical processing are already known. For example, Offenlegungsschrift No. 31 03 030 describes a method in which old sand is introduced under quantitatively controlled conditions into a fluidized bed furnace and is heated and thermally processed by hot gases in such a way that the fine grain component can be separated off. In the furnace, all the old sand is dried such that the clay or bentonite loses its binding capability and its plasticity.

After the thermally treated sand mixture is cooled, the embrittled bentonite crusts around the quartz grains are fed to a striker-type crushing mill having a sifter disposed downstream thereof. In the mill, the solid binding agent residues or crusts are stripped off of the quartz grains. The fine component which is rubbed off is separated from the heavy quartz grains in a sifter.

Upon sufficiently intensive thermal and subsequent mechanical treatment of the old sand, that method can actually produce sand of a quality which approaches new sand. However, a disadvantage of this process is that it requires a relatively high amount of energy. Experiments have shown that this is becausae the entire volume of sand in the furnace must be heated to about 870° C. (1598° F.). On a microscope level, each quartz grain of the sand is heated to the final temperature to its core in order to ensure that all the binder components or bentonite casings around the quartz grains are at the requisite embrittling temperature during the mechanical processing operation. This occurs because the thermal conductivity of quartz is higher than that of the bentonite encasing it. Such heating involves the use of an undesirably large amount of heat.

Another type of sand regenerating system is shown in U.S. Pat. No. 2,456,769 to Christensen et al. In that system, spent foundry sand is dumped into a first crib where the sand is wetted, mixed and mulled. The wet scrubbed material is then conveyed to a second crib in metered quantities where it is simultaneously mulled, mixed and subjected to temperatures of between 900° F. (480° C.) and 1200° F. (650° C.). And finally, the cleaned, hot, dry sand is conveyed to a third crib where it is aerated, cooled and dry scrubbed.

A disadvantage of this process is that, in the second crib, wet sand is introduced to be heated, mixed and mulled. Consequently, much heat energy is lost in the production of steam and vapor which escapes from the crib. Furthermore, in the second crib the burners are positioned directly over the mixing and mulling apparatus, so that the mixing and mulling implements are heated directly by the burners. This direct heating of the implements at elevated temperatures disclosed in that patent would soften the implements and cause them to wear rapidly.

Therefore, there is a need for a process to regenerate old casting sand which requires less energy and a lower capital investment than prior art processes. Such a process preferably does not create excessive wear on the components of the apparatus which performs the process.

SUMMARY

The present invention is a process for regenerating old casting sand in which an intense thermal and mechanical processing of the old sand is effected substantially simultaneously in a single container. By simultaneously agitating and rapidly heating the old sand to a predetermined minimum temperature at a predetermined minimum rate, the binder encasing the sand is removed with a minimal expenditure of energy, when compared to prior art methods.

On a microscopic level, the rapid heating is primarily responsible for the relatively low energy requirements of the process, and capitalizes on the relatively low thermal conductivity of the sand grains. By subjecting the old sand to a sufficiently rapid increase in temperature, the process can be terminated after only the binder is heated to the requisite minimum embrittling temperature, while the encased sand grains reach a much lower average maximum temperature. Since it is not the entire old sand particle that is heated to the embrittling temperature, but only the binder casing, less total heat energy is required than for prior art processes in which lower heating rates are used.

There is another factor, brought about by the rapid heating rate, which accelerates the rate at which the binder is removed from the sand grains. Since the binder reaches a higher temperature than the encased sand grains, the relatively large differences in temperature across the boundary face between the binder and the sand grain creates a thermal shock effect in which the rate of thermal expansion of the binder exceeds the rate of thermal expansion of the sand grains. As a result, the binder literally pulls away from the sand grains.

In order to heat the old sand sufficiently rapidly to achieve the rapid separation of binder from the sand grains wtih a relatively low energy input, the single container into which the old casting sand is placed for processing is provided with a burner which directs a gas flame or stream of heated gas along a first axis within the container such that it impinges upon the old casting sand. Experiments have shown that the desired results are achieved when the gas stream is at a temperature of at least 1400° C. (2550° F.).

However, such a form of energy input creates a relatively localized area of intense heat, and in order to heat the old casting sand uniformly it is necessary to agitate the old sand violently. Particularly effective results are obtained when a rotary crushing tool is placed within the container and rotated about a second axis which is parallel to the first axis of the flame. Since the temperature of the gas stream is at such an elevated temperature, direct contact between the rotary tool and the gas stream would tend to soften the tool and accelerate its rate of wear. Accordingly, in a preferred embodiment the rotary tool is positioned within the container so that the tool does not enter the gas stream.

However, with this arrangement it is necessary that the old sand be circulated between the relatively localized area of intense heating and the portion of the container swept by the rotary tool. This cycling is achieved by rotating the container, which preferably has a cylindrical shape, about a third axis which is parallel to the first and second axes of the gas stream and tool, respectively, and inclined from the vertical. This inclination creates two relatively distinct zones within the container: a lower heating zone in which the sand is contacted directly by the gas stream, and an upper zone in which the casting sand is contacted by the rotary tool and agitated.

However, it should be noted that the container preferably is sized such that the sand throughout the container is in a state of violent agitation, so that the contact between old sand particles provides a measure of the mechanical energy required to break off the embrittled binder from the encased sand grains. Thus, the sand which is directly contacted by the gas stream is being violently agitated in the lower zone almost to the same extent as the sand is being agitated in the upper zone. Therefore, the abrasion effects are imposed upon the old sand even as it is being rapidly heated by the gas stream.

Experiments have shown that, by contacting the old sand with a flame at a temperature of at least about 1400° C. (2550° F.) and simultaneously agitating the contents of the container, the binder is rapidly heated to an embrittling temperature of about 800° C. (1470° F.), while the average temperature of the final sand final sand product is between about 100° C. (212° F.) and about 400° C. (750° F.), preferably between about 250° C. (480° F.) and about 300° C. (570° F.).

The degree of thermal efficiency of the method of the invention can be increased by removing the fine component of the material in the container simultaneously with the heating and agitating steps. The term "fine component" refers to sludge or slurry substances having a grain diameter less than about 200 microns. Preferably, the fine component is removed by introducing suction to the interior of the container. The removal of the fine component during the process continuously reduces the mass of material subjected to the heat and agitation of the invention, and therefore reduces the overall energy requirements of the process.

In another embodiment of the invention, the temperature and/or the degree of cleanliness of the sand mixture being processed are measured during the thermal and mechanical processing, and resultant data is used to generate a control signal for adjusting the intensity of the thermal and/or mechanical action on the sand mixture. Moisture and temperature measurement may be effected in a contactless manner or by sensors, and that measurement signal can be used to generate a control signal which is used, for example, to increase the output of the burner, increase the speed of rotation of the crushing tool, or to change the residence time of the material in the container.

The degree of cleanliness of the sand mixture being processed is measured by removing a portion of the sand mixture being processed from the container and testing is separately during the processing operation. For example, in such a sampling operation, the clay content can be established with a high degree of accuracy in a very short time. If such measurement or test results are converted into control signals, the output of the heat supply means or the mechanical processing tools can be altered, as can the residence time or the period of time for which the material to be treated is subjected to processing. Such sampling operations can be carried out at short intervals of time, so as to provide for optimum processing.

When processing old sand containing lumps, the degree of efficiency of the regeneration method of the invention can be further improved by performing a precrushing operation, before the thermal and mechanical processing step, for breaking up large lumps in the sand mixture at a temperature lower than that attained during the thermal processing step. The pre-crushing operation provides better access for the supply of heat to the individual bentonite casings around the grains of sand, to which a thermal shock is applied by the method of the invention so that the casing portion flies or cracks off and is immediately sucked away in the form of a fine component, preferably during the processing operation.

In another embodiment of the invention, the sand mixture is mixed with a binding agent containing a volatile solvent, or a low melting point binding agent, in a final step of the process. Although this manner of enclosing the grains of sand is already known in other areas, such as in mask molding techniques, those processes provide that after application of the binding agents containing the volatile solvent, the solvent must be heated by hot air which is subsequently applied, or by hot gases, and caused to evaporate. When performed as a final step of the invention, the residual heat from the regeneration operation can be used precisely to cause accelerated evaporation of the solvent.

When using binders in powder form with a low melting point, preferably below 400° C. (750° F.), in conventional methods, heat, for example in the form of hot air, is applied to cause them to melt. In contrast, with the invention the heat required to cause melting of the binder is already contained in the sand which is to be encased. The method of the invention ensures efficient utilization of the energy available when either type of binder is used in the final step.

Accordingly, it is an object of the present invention to provide a method for regenerating old casting sand with a minimum expenditure of heat energy; a method in which old casting sand is regenerated in a single container, thereby minimizing the equipment required; and a method in which the heat applied to remove the binder from the same grains is reused to attach fresh binder to the cleaned sand grains.

Other objects and advantages of the invention will be apparent from the following description, the accompanying drawings and the appended claims.

DETAILED DESCRIPTION OF THE PREFERRED EMBODIMENT

Figure 1:
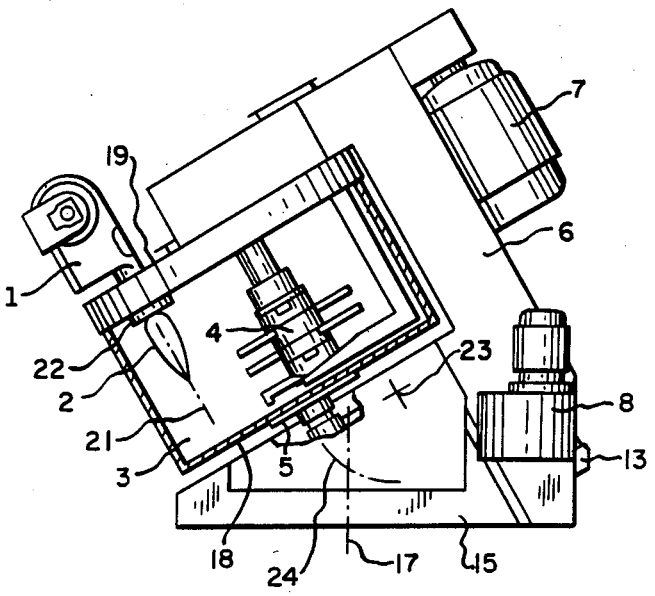
FIG. 1 is a side elevational view in section in partly diagrammatic form of a processing machine for performing the process of the invention, with a burner mounted thereon.
Figure 2:
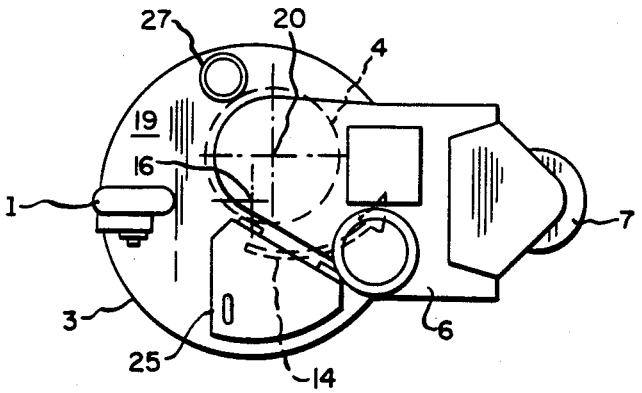
FIG. 2 is a top plan view of the machine shown in FIG. 1.

As shown in FIGS. 1 and 2, the apparatus for regenerating or re-processing old casting or foundry sand has a machine frame structure 6 mounted on a base structure 15 and which carries a rotary container 3. The axis of rotation 16 of the container 3 is disposed at an angle of 25° relative to the vertical 17. Although optimal results occur at this inclination, beneficial results occur at angles of between about 10° and about 60° from the vertical.

The container 3 is cylindrical, with a cylindrical casing side wall which is closed at the bottom by a fixed portion 18 and at the top by a cover 19 which is secured in a stationary position to the machine frame structure 6. The container 3 is driven by a motor 13, partly shown in FIGS. 1, 3 and 4.

The angled arrangement of the axis of rotation 16 of the container 3 defines an upper region in the interior of the container which is to the right in each of the figures of drawings, and a lower region which is disposed opposite to and at a lower elevation than the upper region. Secured to the cover 19 in the upper region is a wall stripping machine with deflection or guide member 14, the baffle or guide plate of which can is arranged in an L-shape and extends in an arcuate configuration over the container base portion 18 along the walls. A vaned rotary tool 4 is attached to the frame 6 and extends into the container 3 in the upper region. The axis of rotation 20 of the crushing tool 4 is disposed parallel to and at an off-center position relative to the axis of rotation 16 of the container 3. The rotary tool 4 is rotated by electric motor 7 carried on the frame 6.

A burner 1 is mounted on cover 19 of the container 3 and includes introducing pipe 22 oriented to direct a flame 2 downwardly into the lower region. The flame 2 is directed along axis 21 which is oriented parallel to the axis 20 of the rotary tool 4.

The base portion 18 of the container 3 is closable by a closure cover 5 and is arranged to be opened by pivoting the base closure cover 5 about an axis of rotation 23 in the direction indicated by the broken curved line 24. The drive for the base closure cover 5 is a hydraulic unit 8, mounted on the base 15.

FIG. 2 shows a plan view of a closure cap member 25 covering a feed opening (not shown), with the curved broken line 14 indicating the wall stripper member and the material deflection or guide member. A flanged port 27 is formed on the cover 19 and opens into the interior of the container 3.

Figure 3:
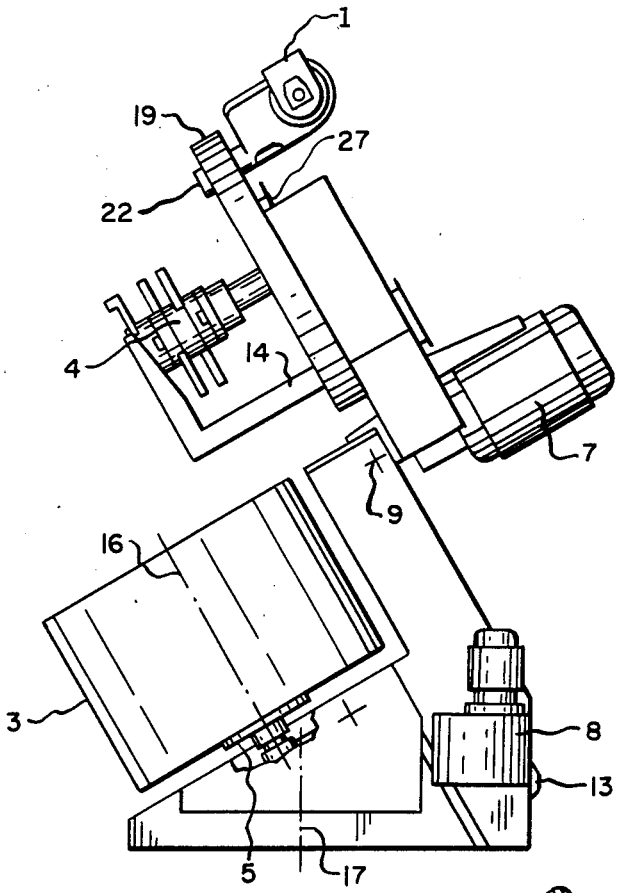
FIG. 3 is a side elevational view in section in partly diagrammatic form of an alternate embodiment having a crushing tool and burner which can be pivoted out of the container.

FIG. 3 shows an alternate embodiment of the apparatus for performing the method of the invention. In this embodiment, the upper portion of the apparatus, including the cover 19, the rotary tool 4, scraper blade 14, burner 1 and motor 7, are pivotally attached to the remainder of the structure at 9 by a hinge or other well-known means. This structure facilitates access to the interior of the container 3, as well as to the tool 4.

Figure 4:
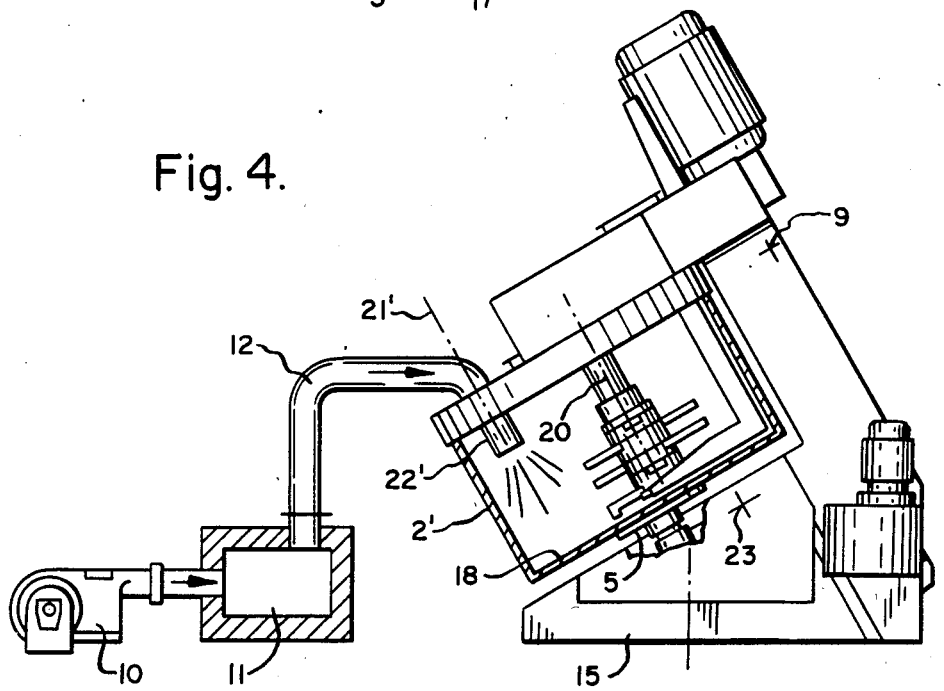
FIG. 4 is a side elevational view to that in section in partly diagrammatic form of another embodiment of the invention using an oil burner as a source of heat.

FIG. 4 shows an alternate embodiment of an apparatus for performing the method of the invention. In this embodiment, heat is supplied in the form of a heated gas which travels through a conduit 12 having a portion 22' extending through the cover 19 (FIG. 1) and into the interior of container 3. The heated gas 2 is directed substantially along an axis 21' which coincides with axis 21 of FIG. 1.

The hot gases 2 are created by an oil burner 10 which directs the burner flame into a chamber 11. Should the apparatus of FIG. 4 be equipped with the pivot feature of FIG. 3, the conduit 12 must be removed from the cover 19 prior to pivoting the cover as shown in FIG. 3.

The operation of the apparatuses of FIGS. 1-4 to practice the method of the invention is virtually identical. Therefore, the method will be explained with reference only to FIGS. 1 and 2, with the understanding being that the explanation applies equally well to FIGS. 3 and 4. The process of the invention may be performed in either a continuous or batch process. However, it is believed that the most efficient operation occurs on a batch basis because the container 3 may be sealed and allow the use of relatively high rotor speeds to generate a high degree of turbulence. Accordingly, the following explanation will be limited to the process of the invention being conducted on a batch basis.

An initial charge of old casting sand is first deposited into the container 3 through the feed opening in the cover 19. The mass of old casting sand received varies, of course, with the size of container 3. The process of invention has been conducted with masses of sand ranging between 50 kg (110 lbs) up to 4 metric tons (8,820 lbs). It is preferable that the old sand be substantially free of moisture at the time it is deposited into container 3. Moisture is undesirable since it will absorb heat, vaporize, and escape from the container, thereby increasing the amount of heat energy required to raise the temperature of the binder to the requisite temperature.

Once the charge of old casting sand has been sealed within the container 3, the burner 1 is ignited, generating a burner frame 2 which extends along the flame axis 21 and is sufficiently powerful to impinge upon the old casing sand material within the container. This jet of burning gas preferably is at a minimum temperature of about 1400° C. (2,550° F.) and creates a somewhat localized area of intense heat.

Simultaneously with the heating of the old casting sand by the burner flame 2, the electric motor 7 is activated to rotate the crushing tool 4 about its axis 20. This tool imparts a high degree of agitation to the old casting sand in both the upper and lower regions. The effect of this agitation is two-fold: it causes the individual old sand grains to abrade against each other, which promotes the removal of the hardened binder from the sand grains, and it promotes the circulation of the sand past the burner flame 2, and therefore, the even heating of the sand grains.

At the same time as the crushing tool 4 is rotating, the container 3 is rotating about its axis 16 by motor 13. It is preferable to rotate the container 3 such that the burner flame 2 is positioned "upstream" of the crushing tool 4, viewed in the direction of rotation of the container. This results in the binder being rubbed off of the individual sand grains before the heat imparted to the old sand can penetrate into the interiors of the sand grains themselves. This further increases the thermal and mechanical efficiency of the method of the invention. As shown in FIG. 2, the "upstream" position of the burner would be achieved for a clockwise rotation of the container 3, since the distance traveled by the sand from the burner to the crushing tool is the shortest for that sense of rotation.

With regard to the rotational speed of the crushing tool 4, experiments have indicated that an optimum range of rotor tip speed is between about 15 m/sec (49 fps) and about 40 m/sec (131 fps). A preferred range of tip speeds is between 25 m/sec (82 fps) and 30 m/sec (98 fps). Although the optimal speed may vary depending upon the type of old casting sand being processed and the degree of cleanliness desired, it is necessary in all cases to utilize relatively high tip speeds in order to impart the necessary high turbulence and agitation to the casting sand within the container.

In order to induce a proper amount of thermal shock to the old casting sand, it is preferable that the old sand enter the container 3 at a temperature approximately equal to ambient temperature, that is, about 20° C. (68° F.). When the old sand passes beneath and is contacted by the burner flame at 1400° C. (2550° F.), the temperature of the binder increases in a fraction of a second from ambient temperature to at least 800° C. (1470° F.).

In contrast, it requires a matter of minutes for the sand grains themselves to be elevated from a temperature of approximately 20° C. (68° F.) to a final, average temperature of between 100° C. (212° F.) and 400° C. (750° F.), generally between about 300° C. (570° F.) and 400° C. (750° F.). Experiments have shown that the rate of temperature increase of the binder is between about 320° C./min. (590° F./min.) and about 533° C./min. (980° F./min.) for a period of between approximately 1.5 and 2.5 minutes. The energy requirements range between 120,000 kg-cal to approximately 200,000 kg-cal per metric ton (216 btu/1b to 360 btu/lb) of sand.

The extreme difference in temperature causes a "thermal shock" to be imparted to each particle of old casting sand so that stresses are imposed upon the boundary faces between the binder and sand grains, resulting from the different rates of expansion of the binder and sand grain. This thermal shock accelerates the separation of the binder from the sand grains and works together with the abrasion created by contact between old sand particles and the crushing action imposed by the crushing tool 4.

After the binder reaches a temperature of about 800° C. (1470° F.) it becomes embrittled and, as a result of the thermal shock and mechanical agitation imparted by the rotary tool 4 and abrasion between grains of sand, disintegrates and is separated from the sand grains.

It is preferable to offset the rotary tool 4 from the flame axis 21 sufficiently to remove the rotary tool from direct contact with the flame. Since the high temperatures of the burner flame 2 tends to soften the vanes of the rotary tool, the life of the tool will be enhanced if it is out of the region of intense heating.

The heat requirements of the process may be reduced by introducing suction through the flanged port 27 in the cover 19. Such suction preferably is accomplished by inserting a pipe connected to a source of vacuum or low pressure through the port and into the interior of the container 3. The level of sand within the container, of course, will determine the appropriate length of pipe to be inserted into the container. By removing the fine particles by way of the suction of such a device, the overall mass of material within the container is reduced, thereby reducing the amount of heat required to elevate the binder to the requisite embrittling temperature.

After the binder, which has been embrittled by contact with the high temperature flame, has been removed from the sand grains by the turbulence imparted by the rotary tool 4 and container rotation 3, and removed partially or entirely by the suction device, the clean sand is discharged through the base upon the opening of closure cover 5.

While the forms of apparatus herein described constitute preferred embodiments of the invention, it is understood that the invention is not limited to these precise forms of apparatus, and that changes may be made therein without departing from the scope of the invention.

What is claimed is:

1. A method of regenerating old casting sand comprised essentially of sand grains encased within a clay binder subject to thermal embrittlement, comprising the steps of:

providing a container having a cylindrical side wall and a bottom wall supported for rotation about a first axis that is inclined relative to a vertically extending plane, the container having upper and lower regions with each region having the bottom wall as one of its boundaries, a nonrotatable cover for closing said container, and an L-shaped stripping member secured to said cover to extend within the container adjacent said cylindrical side wall into said upper region and then along said bottom wall towards said lower region;

positioning a crushing tool within said container for rotation about a second axis of rotation arranged parallel to the first axis, with the crushing tool being positioned intermediate said upper and lower regions;

introducing old casting sand into said container;

rotating said container about said first axis and rotatins said crushing tool about said second axis thereby generating substantial turbulence of said old casting sand within said container;

directing a hot gas into said lower region along a further axis that is disposed parallel to said first and second axes, passing the turbulent old casting sand through said hot gas, thereby heating said binder of said turbulent old casting sand passing therethrough to a temperature at which thermal embrittlement thereof occurs, thereby embrittling said binder, and then immediately impinging said old casting sand on said crushing tool, thereby separating portions of said binder embrittled by passage through said hot gas from said sand grains prior to the heating of said sand grains to said temperature;

removing the separated portions of said embrittled binder from said container by a vacuum applied adjacent said crushing tool.

* * * * *

UNITED STATES PATENT AND TRADEMARK OFFICE

CERTIFICATE OF CORRECTION

PATENT NO. : 4,681,267

DATED : July 21, 1987

INVENTOR(S) : Dieter S. Leidel et al

It is certified that error appears in the above-identified patent and that said Letters Patent is hereby corrected as shown below:

On the Title page, item [73],

"Assignee: Dieter S. Leidel, Barrie, Ontario, Canada"

On The Title page, item [57],

Abstract, line 17 - "oil" should be ---old---.

line 18 - "the" should be ---that---.

Col. 1, line 21 - "sue" should be ---use---.

Col. 5, line 66 - after "fixed", insert ---base---.

Col. 6, line 9 - "machine" should be ---member---.

Col. 7, line 17 - "frame" should be ---flame---.

Col. 9, lines 13-14 - "rotatins" should be ---rotating---.

Signed and Sealed this

Twentieth Day of July, 1993

*Attest:*

Michael K. Kirk

MICHAEL K. KIRK

*Attesting Officer*

*Acting Commissioner of Patents and Trademarks*